United States Patent [19]

Merkle et al.

[11] 4,146,231

[45] Mar. 27, 1979

[54] GOLF SWING PRACTICE PLATFORM

[76] Inventors: John W. Merkle; Roberta T. Merkle, both of 3740 58th St. North, Apt. 107, St. Petersburg, Fla. 33710

[21] Appl. No.: 829,195

[22] Filed: Aug. 30, 1977

[51] Int. Cl.[2] ..... A63B 69/36

[52] U.S. Cl. ..... 273/187 R; 273/195 B; 273/200 B

[58] Field of Search ..... 273/195 R, 195 A, 195 B, 273/187 R, 187 A, 187 B, 183 A, 200 B

[56] References Cited

U.S. PATENT DOCUMENTS

| | | | |
|---|---|---|---|
| 2,295,599 | 9/1942 | Mozel | 273/183 A X |
| 2,786,683 | 3/1957 | Shapiro | 273/183 A |
| 3,415,523 | 12/1968 | Boldt | 273/195 B X |
| 3,473,811 | 10/1969 | Lees | 273/187 R X |
| 3,638,950 | 2/1972 | Hyotlaine | 273/187 R |
| 3,994,501 | 11/1976 | O'Donnell | 273/187 R X |
| 4,023,810 | 5/1977 | Lorang | 273/195 B X |

*Primary Examiner*—George J. Marlo
*Attorney, Agent, or Firm*—Walter J. Monacelli

[57] ABSTRACT

A main frame for support from the ground is provided and a pair of right and left foot support plates are mounted on the frame in spaced side-by-side relation. The first foot plate is supported from the frame for shifting toward and away from the left foot plate and the latter is supported from the frame for oscillation about a horizontal axis extending normal to a path extending between the plates. A pair of signal generator actuating switches are operatively associated with the frame and the left foot support plate for indicating predetermined positions of opposite angular displacement of the left foot support plate relative to the frame and the right and left foot support plates include toe guides for positioning the toe of the associated golfer's shoes. In addition, the left foot plate includes a heel guide for positioning the heel of the left shoe of the golfer. The frame also adjustably supports an elongated guide support outwardly therefrom in position generally paralleling the aforementioned path and for lateral adjustment toward and away from the frame and the support includes structure for supporting a golf ball therefrom.

12 Claims, 11 Drawing Figures

GOLF SWING PRACTICE PLATFORM

BACKGROUND OF THE INVENTION

Various forms of practice devices have been heretofore provided to assist golfers in practicing their golf swings. However, most of these devices have not included structure whereby adjustments thereof according to the particular golfer's needs may be readily made. In addition, other forms of golf swing practice devices have not been constructed in a manner whereby a plurality of aspects of the golfer's swing may be benefited.

Examples of various forms of golf swing practice devices including some of the general structural and operational features of the instant invention are disclosed in U.S. Pat. Nos. 2,941,808, 3,009,704, 3,110,495, 3,142,487, 3,860,247, 3,955,812 and 3,994,501.

BRIEF DESCRIPTION OF THE INVENTION

The golf swing practice platform of the instant invention is constructed in a manner whereby a golfer may practice and correct various aspects of his golf swing. The practice platform is adaptable for use in practicing tee shots as well as for use in practicing fairway shots.

The main object of this invention is to provide an apparatus which is operative to check and assist in correction of the weight shift of a golfer during his swing.

Another object of this invention is to provide a golf swing practice device which will enable a golfer to check and correct for proper weight distribution while he is addressing a ball prior to his swing.

Still another object of this invention is to provide an apparatus which includes structure for checking and facilitating correction of weight shift and timing during the backswing.

A still further object of this invention is to provide an apparatus which will be operative to check and facilitate in correcting weight shift and timing during the downswing.

Another object of this invention is to provide an apparatus for checking and facilitating correction of weight shift and timing during the follow through.

A further object of this invention is to provide an apparatus for establishing the proper distance between the feet and the golf ball.

Another object of this invention is to provide an apparatus including structure whereby proper distance between the left foot and the right foot may be maintained.

A still further object of this invention is to provide an apparatus which will facilitate proper placement of the golf ball between the left foot and the right foot.

Yet another object of this invention is to provide an apparatus which will be capable of facilitating proper toe and heel alignment.

A still further object of this invention is to provide an apparatus which will be capable of facilitating proper swinging of the golfer without body sway.

A final object of this invention to be specifically enumerated herein is to provide a golf swing practice platform in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
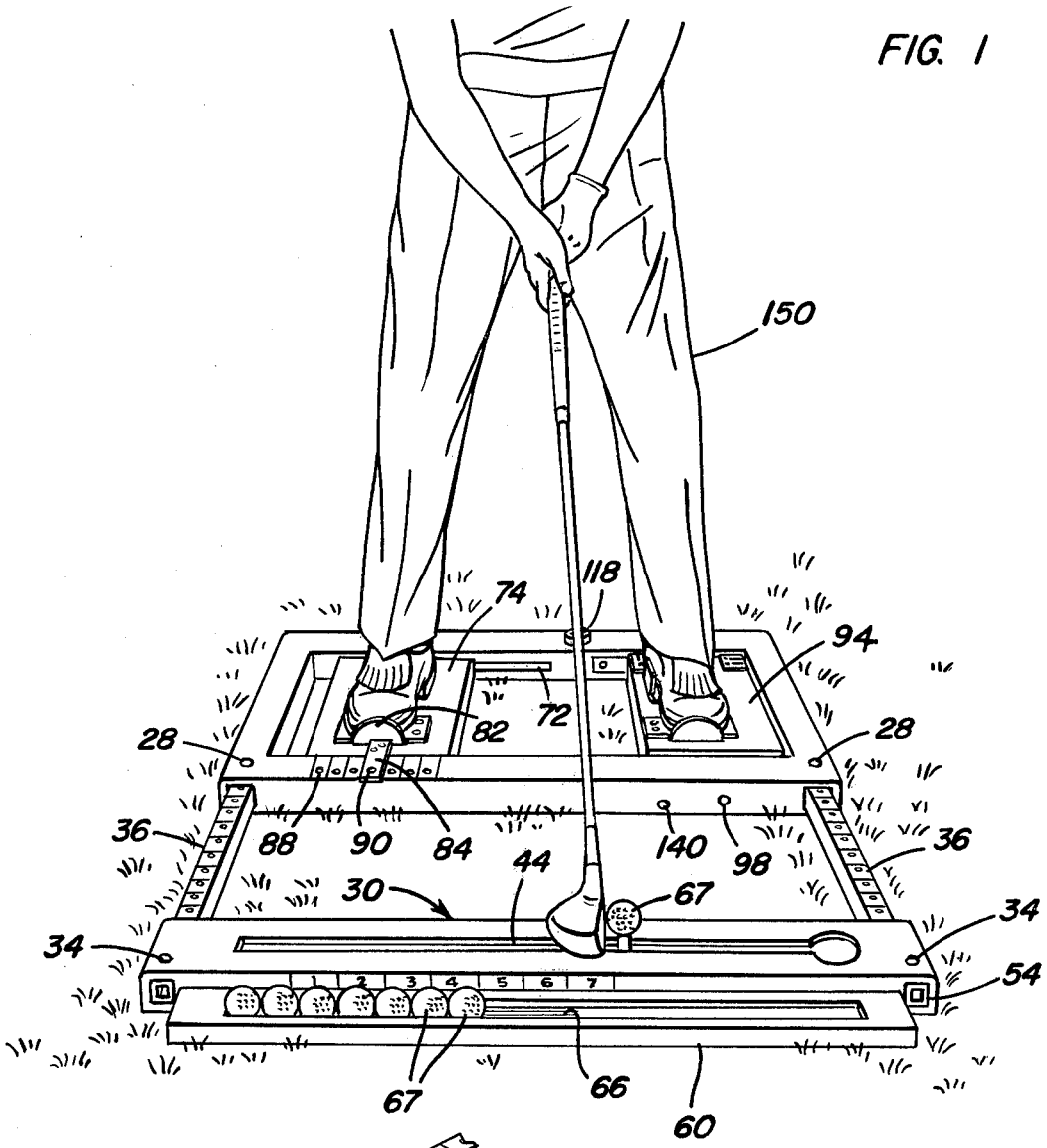
FIG. 1 is a perspective view of the golf swing practice platform of the instant invention with the tee frame in position thereon and with an associated golfer in proper stance immediately prior to the beginning of his backswing.

Referring now more specifically to the drawings, the numeral 10 generally designates the golf swing practice platform of the instant invention. The platform 10 includes a main frame referred to in general by the reference numeral 12 and including front and rear longitudinal members 14 and 16 interconnected by means of opposite end front and rear extending members 18 and 20. The end members 18 and 20 define sleeve members having longitudinal passages 22 extending therethrough and the top and bottom wall portions of the front ends of the end members 18 and 20 have vertically registered bores 24 and 26 formed therethrough. A pair of locking pins 28 are removably passed through each pair of bores 24 and 26.

An elongated tee frame referred to in general by the reference numeral 30 is provided and is spaced outwardly of and generally parallels the front member 14 of the frame 12. The opposite ends of the tee frame 30 have transverse passages 32 formed therethrough and the top and bottom wall portions of the opposite ends of the tee frame 30 include bores (not shown) corresponding to the bores 24 and 26 and through which locking pins 34 corresponding to the locking pins 28 are removably received.

A pair of elongated front to rear extending opposite side rails 36 are provided and the rear ends of the rails 36 are adjustably secured in position within the passages 22 by means of the pins 28, each of the rails 36 being tubular in configuration and including longitudinally spaced pairs of vertically registered bores 38 through which the pins 28 are receivable. In addition, the forward ends of the rails 36 are provided with vertically registered bores (not shown) similar to the bores 38 through which the pins 34 are received. Each of the rails 36 includes a longitudinally extending scale 40 and each scale 40 includes indicia 42 spaced therealong which may be selectively registered with the front side of the front member 14 to determine predetermined spacing of the tee frame 30 forwardly of the forward member 14 of the main frame 12.

The tee frame 30 includes an upwardly opening inverted T-shaped slot 44 formed therein and the enlarged lower end portion 46 of a tee 48 is slidingly received within the slot 44, the tee 48 including an upwardly opening recess 50 in its upper end in which the lower periphery of a golf ball may be cradled.

In lieu of, or in addition to, the tee frame 30, a fairway frame referred to in general by the reference numeral 52 is provided. The fairway frame 52 includes passages 54 therethrough corresponding to the passages 32 and additionally includes bores similar to those provided in the frame 30 for receiving the pins 34 therethrough. Also, it will be noted that the fairway frame 52 includes opposite end forwardly and outwardly opening bores 56 and a central downwardly opening recess 58. An elongated ball return member 60 is provided and is notched as at 62 on its opposite ends for interlocked engagement with the frame 52. Ball return member 60 further includes pins 64 projecting rearwardly out of the notches 62 and which are engageable in the bores 56 in order to firmly support the ball return member 60 from the fairway frame 52. The tee frame 30 includes bores corresponding to the bores 56 and a recess corresponding to the recess 58 whereby the ball return member 60 may also be supported from the tee frame 30, see FIG. 2.

Figure 11:
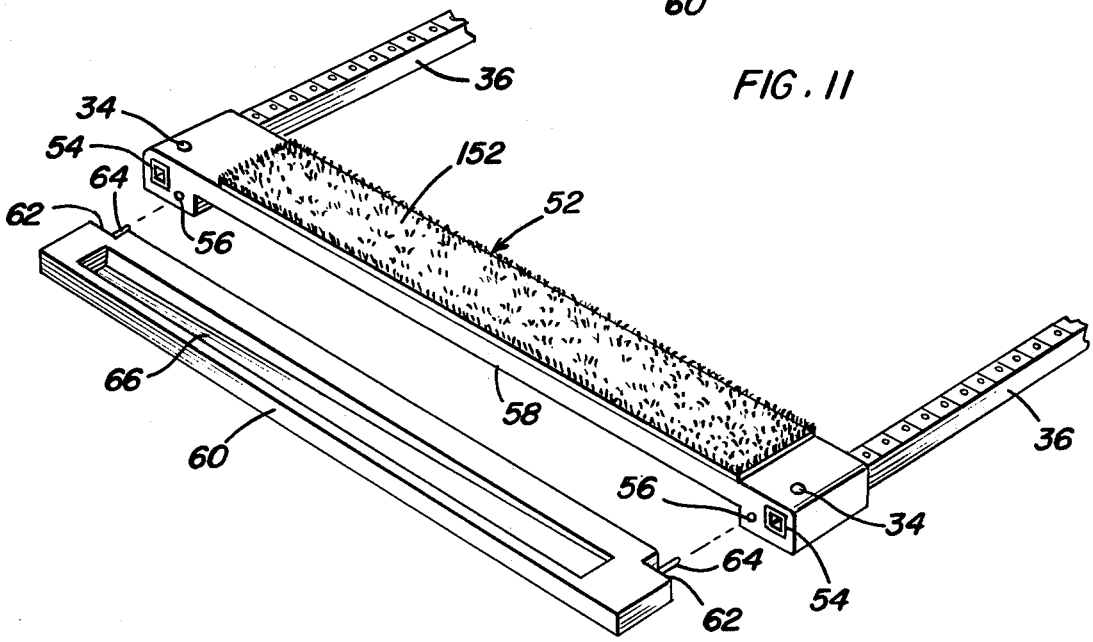
FIG. 11 is a fragmentary perspective view illustrating the manner in which the fairway frame may be utilized in lieu of the tee frame illustrated in FIG. 2 and also with the ball return in exploded position relative to the fairway frame.
Figure 2:
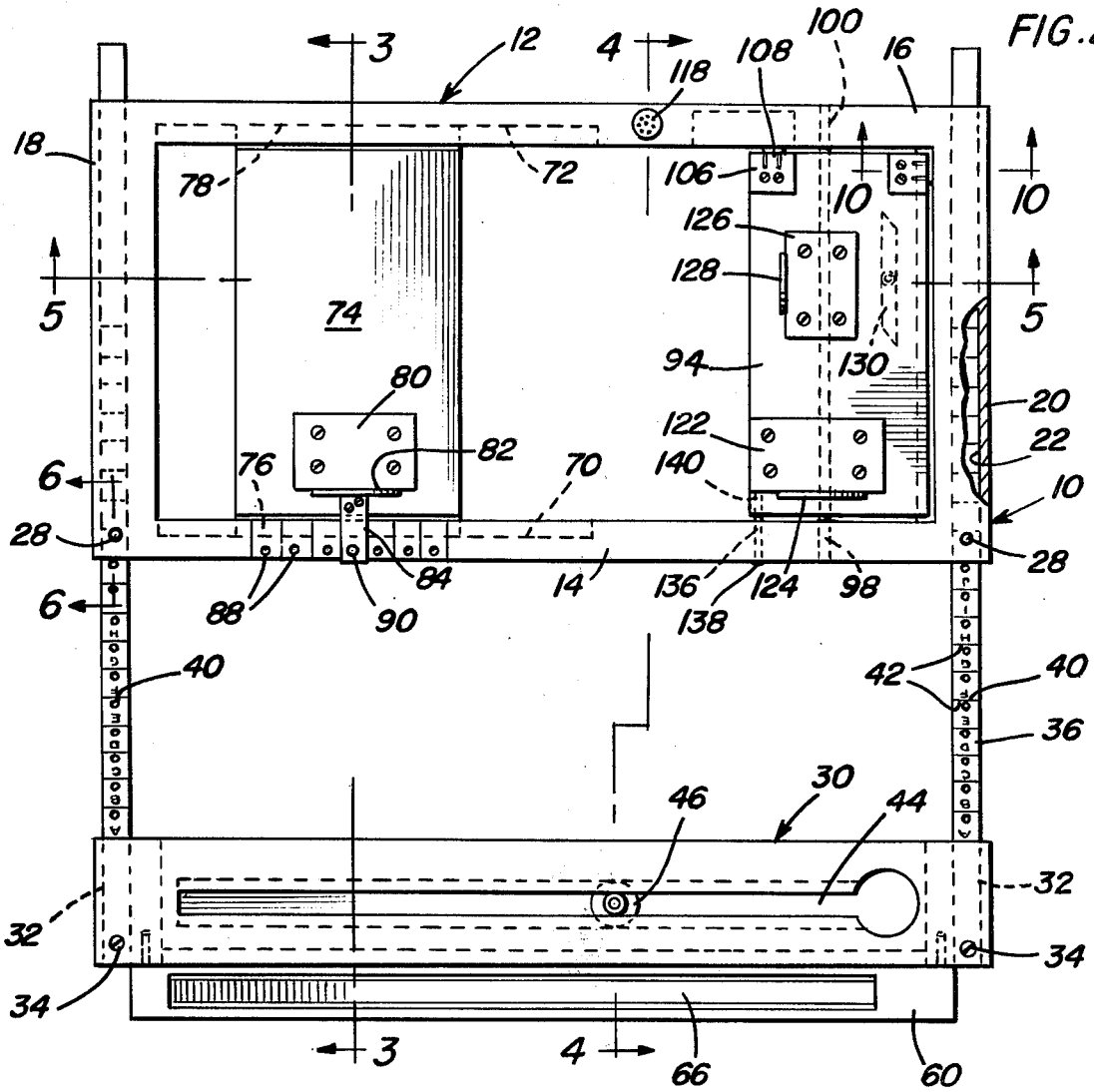
FIG. 2 is an enlarged top plan view of the platform.
Figure 9:
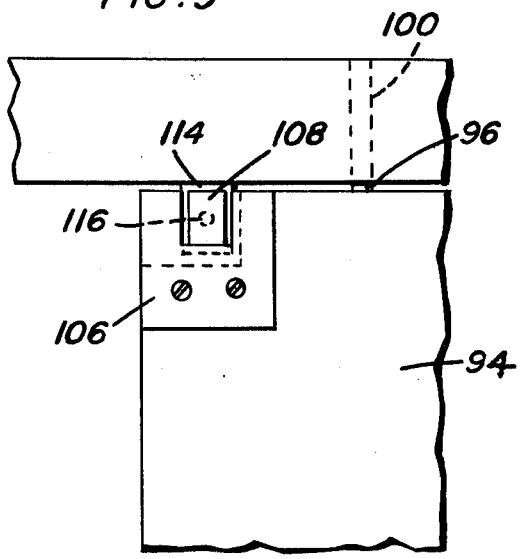
FIG. 9 is an enlarged fragmentary top plan view of the upper left hand portion of the left foot platform illustrated in FIG. 2.
Figure 10:
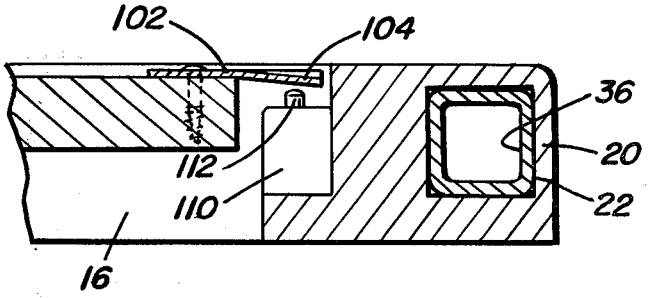
FIG. 10 is an enlarged fragmentary vertical sectional view taken substantially upon the plane indicated by the section line 10—10 of FIG. 2.
Figures 3, 4, 5, 6, 7, 8:
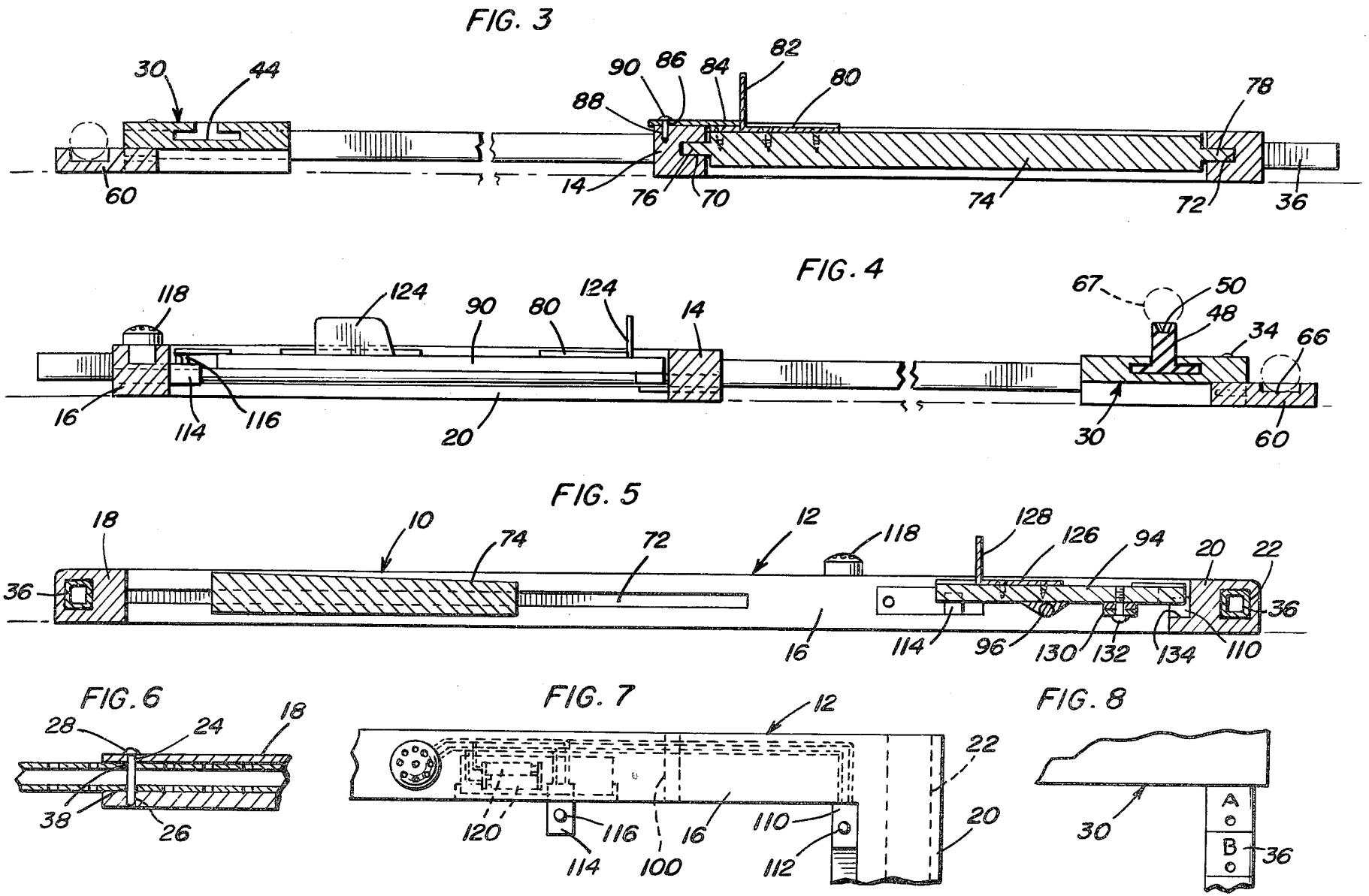
FIG. 3 is an enlarged fragmentary vertical sectional view taken substantially upon the plane indicated by the section line 3—3 of FIG. 2.
FIG. 4 is an enlarged fragmentary vertical sectional view taken substantially upon the plane indicated by the section line 4—4 of FIG. 2.
FIG. 5 is an enlarged vertical sectional view taken substantially upon the plane indicated by the section line 5—5 of FIG. 2.
FIG. 6 is an enlarged fragmentary vertical sectional view taken substantially upon the plane indicated by the section line 6—6 of FIG. 2.
FIG. 7 is a fragmentary enlarged perspective view of the upper right hand portion of the frame of the platform illustrated in FIG. 2.
FIG. 8 is an enlarged fragmentary plan view of the lower left hand portion of the apparatus illustrated in FIG. 2.

The ball return member 60 includes an upwardly opening elongated longitudinally extending recess 66 which increases in depth toward the left hand end thereof illustrated in FIGS. 1, 2 and 11 and in which a plurality of golf balls 67 may be placed. The golf balls 67, resting in the recess 60 against the inclined bottom wall thereof, tend to roll toward the left hand end of the recess 66 in the manner illustrated in FIG. 1 of the drawings.

With attention now invited more specifically to FIGS. 1 through 5, it may be seen that the rear side of the left hand end of the forward member 14 includes a longitudinally extending groove 70 formed therein and that the front side of the rear member 16 includes a similar groove 72 formed therein. A right foot support platform 74 is provided and includes front and rear tongues 76 and 78 slidable in the grooves 70 and 72 whereby the right foot platform 74 may be shifted toward and away from the end member 18. The upper surface of the forward end of the right foot platform 74 has an L-shaped toe guide 80 supported therefrom including an upstanding abutment flange 82 and the toe guide 80 further includes a forwardly projecting tongue 84 which overlies the forward member 14 and has a vertical bore 86 formed therein selectively registrable with upwardly opening bores 88 formed in and spaced along the forward member 14. A pin 90 corresponding to the pins 28 and 34 is removably insertable through the bore 86 and into a selected bore 88 for maintaining proper positioning of the right foot support platform 74 relative to the frame 12.

A left foot support platform 94 is also provided and the left foot platform 94 has a front to rear extending support shaft 96 mounted on its undersurface. The opposite front and rear ends of the shaft 96 are rotatably received in corresponding bores 98 and 100 formed in the front and rear members 14 and 16 and in this manner the left foot support platform 94 is oscillatably supported from the frame 12 between the forward and rear members 14 and 16.

The rear right hand portion of the left foot support platform 94 (as seen in FIG. 2) includes a switch actuator 102 supported therefrom including a spring switch actuating tongue 104 and the left rear portion of the platform 94 includes a switch actuator 106 including a spring switch actuating tongue 108. A switch 110 is supported from the end member 20 beneath the tongue 104 and includes a depressable switch operator 112 which may be engaged by the tongue 104. In addition, a switch 114 is supported from the rear member 16 beneath the tongue 108 and includes a switch operator 116 engageable by the tongue 114. The switches 110 and 114 are connected in parallel to a buzzer 118 supported from the rear member 16 and the circuitry by which the switches 110 and 114 are connected to the buzzer 118 includes batteries 120 whereby the buzzer 118 will be electrically actuated upon depression of either the operator 112 of the switch 110 or the operator 116 of the switch 114.

In addition to the toe guide 80 supported from the right foot support platform 74, a similar toe guard 122 is supported from the left foot support platform 94 and includes an upstanding abutment flange 124 corresponding to the flange 82. Still further, the left foot support platform 94 additionally includes a heel guide 126 including an upstanding abutment flange 128 and the underside of the left foot support platform 94 has a locking lever or link 130 oscillatably supported therefrom by means of a pivot fastener 132 and the lever 130 may be swung to a position received in the recess 134 formed in the end member 20, see FIG. 5, in order to prevent the adjacent side of the left foot support platform 94 from being depressed. In addition, the front member 14 includes a bore 136 formed therethrough in which a locking pin 138 may be received and the front edge of the left foot support platform 94 includes a bore 140 in which the pin 138 may also be received in order to lock the left foot platform against oscillation relative to the frame 12.

In operation, if the golf swing practice platform is to be utilized in practicing tee shots, the tee frame 30 is mounted on the forward ends of the side rails 40 and the tee frame 30 is adjustably spaced forward of the forward member 14 and secured in adjusted position by means of the pins 28. A plurality of balls 67 may be placed within the channel or recess 66 and the tee may be placed in the groove or slot 44 and adjusted in position therein. Thereafter the right foot support platform 74 may be adjustably positioned toward and away from the end member 18 and secured in position by means of the pin 90. The pin 138 is removed and the lever or link 130 is pivoted to the position thereof illustrated in FIGS. 2 and 5.

Thereafter, the golfer 150 may assume his stance on the support platforms 74 and 94 with the toes of his shoes abutted against the flanges 82 and 124 and inside of the heel of his left shoe abutted against the flange 128. Thereafter, the golfer 150 may practice his tee shots. The buzzer 118 is activated when the body sways on the backswing and when the body weight is shifted to the left side on the downswing. The buzzer helps to avoid body sway during the backswing and determines proper weight shift and timing on the downswing. The tongues 104 and 108 may each be adjusted by bending in order to actuate the corresponding switch operators at the proper point and it may be seen that adjustment of the right foot support platform 74 will provide the golfer 150 the proper stances. Further, adjustment of the frame 30 forwardly of the forward member 14 and the main frame 12 will also provide proper spacing between the feet of the golfer 150 and the ball 67 on the tee 48.

If the golfer 150 is to practice fairway shots, the tee frame 30 may be removed and replaced by the fairway frame 52, the latter being covered with artificial turf 152.

If it is desirable, both platforms 74 and 90 may be supported for oscillation relative to the frame 12, the platform 74 oscillatably supported from followers slidable in the grooves 70 and 72, and each of the oscillatable platforms may have one of the switches 110 and 114 operatively associated therewith.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A golf swing practice device including a base adapted for support from a horizontal surface, a pair of foot support platforms supported from said base in side-by-side spaced relation, and for adjustable shifting of at least one of said platforms relative to said base toward and away from the other platform, a first of said platforms being supported from said base for oscillation relative thereto about a horizontal axis disposed generally normal to a line extending between said platforms and signal means operatively associated with at least said first platform and base for rendering a signal should said first platform exceed at least one position of a pair of opposite predetermined opposite positions of oscillation relative to said base and including an elongated support generally paralleling said line and means operatively connecting said support with said base for selected lateral shifting toward and away from said platforms with said support generally horizontally aligned with said platforms, said support including golf ball means for support of a golf ball in stationary position thereon, wherein said elongated support includes a longitudinally extending guide, said golf ball support means comprising an upstanding tee supported from said guide for slidably adjustable positioning therealong.

2. The combination of claim 1 wherein said signal means includes means operative to adjustably vary said predetermined position.

3. The combination of claim 1 wherein said platforms include upstanding toe abutment flanges for positioning the toe portions of the shoes of a practicing golfer thereagainst.

4. The combination of claim 3 wherein said first platform also includes an upstanding abutment flange for positioning the heel portion of the corresponding shoe of the practicing golfer thereagainst.

5. The combination of claim 1 wherein said signal means includes electrical switch means operatively associated with said first platform and said base and electrically connected, in parallel, with an electrically actuated signal generator.

6. The combination of claim 5 wherein said signal generator includes means, when said generator is electrically actuated, to generate an audible signal.

7. The combination of claim 6 wherein said switch means includes adjustable means for establishing adjusted opposite positions of oscillation of said first platform operative to electrically actuate said generator.

8. The combination of claim 1 wherein said elongated support includes a generally horizontal upper surface portion, and a pile equipped panel member disposed over said upper surface portion.

9. The combination of claim 8 wherein said signal means includes means operative to adjustably vary said predetermined position.

10. The combination of claim 9 wherein said signal means includes a pair of electrical switch means operatively associated with said first platform and said base and electrically connected, in parallel, with an electrically actuated signal generator.

11. The combination of claim 10 wherein said signal generator includes means, when said generator is electrically actuated, to generate an audible signal.

12. The combination of claim 1 wherein said practice device includes ball storage means defining an elongated horizontal and upwardly opening ball storage area supporting a single row of golf balls and extending along the side of said elongated support remote from said platforms, said ball storage means being detachably supported from said support.

* * * * *